US005601521A

United States Patent [19]

Plamas Xapelli

[11] Patent Number: 5,601,521

[45] Date of Patent: Feb. 11, 1997

[54] METHOD FOR MANUFACTURING A DIVIDER FOR A CARDBOARD BOX

[75] Inventor: Maria J. Plamas Xapelli, Barcelona, Spain

[73] Assignee: Videcart, S.A., Navarra, Spain

[21] Appl. No.: 437,467

[22] Filed: May 9, 1995

[30] Foreign Application Priority Data

May 10, 1994 [ES] Spain ..... 9400980

[51] Int. Cl.[6] ..... B31F 5/04; B31B 1/14

[52] U.S. Cl. ..... 493/346; 493/343; 493/89; 493/90; 493/91; 493/92; 493/381; 156/197

[58] Field of Search ..... 493/381, 343, 493/346, 89, 90, 91, 92, 966, 355, 372; 156/197, 290, 291, 292, 324; 83/333, 331

[56] References Cited

U.S. PATENT DOCUMENTS

| | | | |
|---|---|---|---|
| 3,011,672 | 12/1961 | Vesak | 156/197 |
| 3,018,205 | 1/1962 | Barut | 156/197 |
| 3,493,450 | 2/1970 | Judge, Jr. | 156/197 |
| 3,713,954 | 1/1973 | Clark et al. | 156/197 |
| 3,741,840 | 6/1973 | Booth | 156/197 |
| 4,829,747 | 5/1989 | Johnson, Jr. et al. | 493/91 |
| 4,992,132 | 2/1991 | Schmidcin et al. | 156/197 |

FOREIGN PATENT DOCUMENTS

| | | | |
|---|---|---|---|
| 189979 | 7/1964 | Sweden | 493/966 |

*Primary Examiner*—Jack W. Lavinder
*Assistant Examiner*—Darren Ark
*Attorney, Agent, or Firm*—Steinberg, Raskin & Davidson, P.C.

[57] ABSTRACT

The source materials are supplied in continuous strips of cardboard situated initially in separated planes laterally offset from each other. Longitudinal grooves are made along the strips, dividing them into longitudinal bands. The strips are overlapped and glued under pressure to join them together. Once glued they are cut into pieces. The pieces constitute the folded dividers, made up of sections and folded and glued sections which form the union between the sections of each strip. Optionally, narrower sections are glued directly onto the sides of a box, or to sheets glued in their turn to the sides of the box. The upper edges of the divider can be straight or present recesses. The divider formed by strips glued by the sections which make up sections at right angles to the strips is folded and unfolded at the same time as the box into which it is fitted.

9 Claims, 3 Drawing Sheets

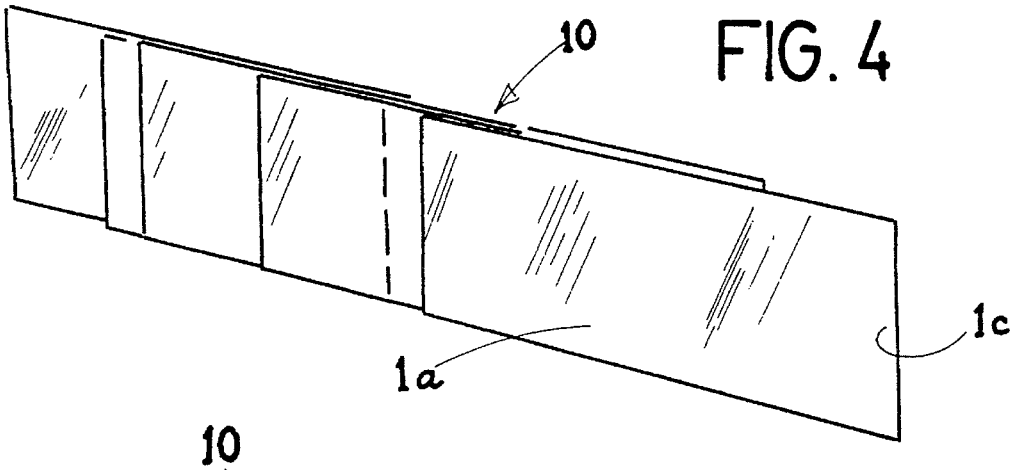
FIG. 4
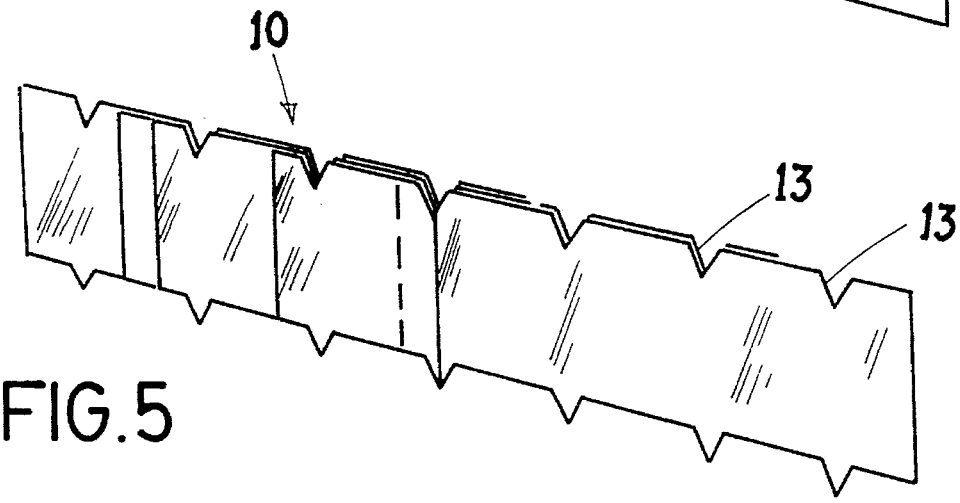
FIG. 5
FIG. 6
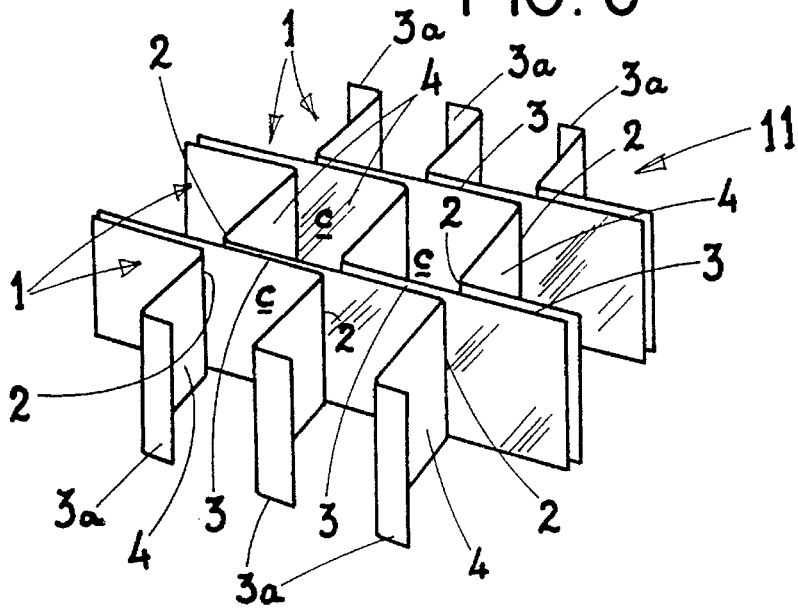

METHOD FOR MANUFACTURING A DIVIDER FOR A CARDBOARD BOX

The present invention refers to a divider for foldable cardboard boxes and a method for manufacturing said divider, made up of an assembly of sheets of cardboard or other similar material, joined to each other in perpendicular positions so that they make up small cells or compartments for holding bottles or similar fragile objects, perfectly separated from each other.

BACKGROUND OF THE INVENTION

Known in the art are dividers for foldable cardboard boxes formed by assemblies of sheets or strips provided with complementary cuts for slotting in the intercrossed sheets. In these known embodiments, only some of the sheets are glued to an internal side of the box; the other sheets are attached only to those which are glued to the box, but are not themselves attached to it.

These dividers are configured in such a way that they are folded at the same time as the box, though the fact that not all the sheets are attached to the sides thereof provokes that the divider moves out of its correct position, which creates difficulties for folding and unfolding it.

Another type of known divider is made up of a plurality of cardboard sheets provided with cutting lines and folding lines which serve to form flaps and strips in directions perpendicular to the flaps, those of one sheet being glued to those of the sheet immediately adjacent to it, so that they can be folded and unfolded at will, while the strips of the sheets situated at the ends of the assembly are glued to the sides of the box.

Although these dividers have advantages over the traditional dividers formed by sheets or strips with cuts to slot them into intercrossed position, they are rather slow to manufacture and the process must be implemented using precut sheets which are later submitted to a process of die-cutting, folding and gluing. The known dividers are usually formed from ridged cardboard sheets whose rigidity prevents feed from bobbins, for which reason supply must be implemented, as stated above, in the form of precut sheets, which means that the entire manufacturing process cannot be implemented continuously.

DESCRIPTION OF THE INVENTION

The divider for cardboard boxes and a method for manufacturing the divider object of the present invention have been designed in order to solve the disadvantages outlined.

The divider is made up of an assembly of strips or sheets of cardboard or similar material arranged in positions perpendicular to each other to form a plurality of compartments, at least some of which sheets or strips can be glued onto two opposite sides of the box. On the basis of this general embodiment, the divider is characterized in that it comprises an assembly of sheets provided with transverse fold lines, which make up bands folded in perpendicular directions with respect to bands juxtaposed and glued to the immediately adjacent sheets. The ends of the sheets which are situated on at least two opposite sides of the assembly are provided with flap-like bands folded transversally, those on each side being coplanar, glued to as many opposite sides of a box.

In a possible embodiment, the folded flaps of at least two opposite sides of the assembly are glued to some sheets which are in turn juxtaposed on the corresponding sides of the box.

Advantageously, one of the ends of each sheet situated on the opposite sides of the divider has one of its ends resting against the corresponding side of the box, in order to keep the divider unfolded.

At least one of the longitudinal edges of the sheets is provided with recesses which narrow progressively from the aforesaid edges.

The method for manufacturing dividers for foldable cardboard boxes comprises continuously feeding strips of flexible material which move along a path, said strips being provided with longitudinal grooves which will form fold lines in one or the other direction. These lines divide the strips into longitudinal bands of different widths, on at least some of which glue is placed. The strips are situated in different planes at the start of their travel, and as they move downstream they converge progressively until they are overlapped on each other and glued under pressure, each strip to those immediately adjacent, in positions which are laterally offset from each other, in order to form an assembly of strips overlapped and glued, which is then subjected to at least one transverse cutting operation to provide pieces which will constitute the folded dividers which will be glued to at least two opposite sides of a box.

In a more specific embodiment, the glue is applied in bands, the bands of each sheet being offset with respect to those of the following sheets according to several imaginary lines in a diagonal direction with respect to the assembly of sheets.

In a possible embodiment, the assembly of overlapped and glued strips is cut along straight lines.

Provision has also been made for the assembly of overlapped and glued strips being cut along lines which form recesses and projections.

BRIEF DESCRIPTION OF THE DRAWINGS

For a better understanding of all that is set out in this specification, some drawings are attached which, solely by way of example, show a practical example of embodiment of the method for manufacturing the divider and of the divider assembly obtained using it.

In these drawings, FIG. 4 shows a folded divider at a larger scale; FIG. 5 is a view similar to that of FIG. 4, but with a folded divider provided with angular recesses on one of the longitudinal edges of the sheets and projections on the opposite edge; FIG. 6 is a perspective view of a folded divider with folded flaps on two opposite sides; FIG. 8 is a view similar to that of FIG. 7, showing a divider provided with sheets on all four sides, while

DESCRIPTION OF A PREFERRED EMBODIMENT

Figure 1:
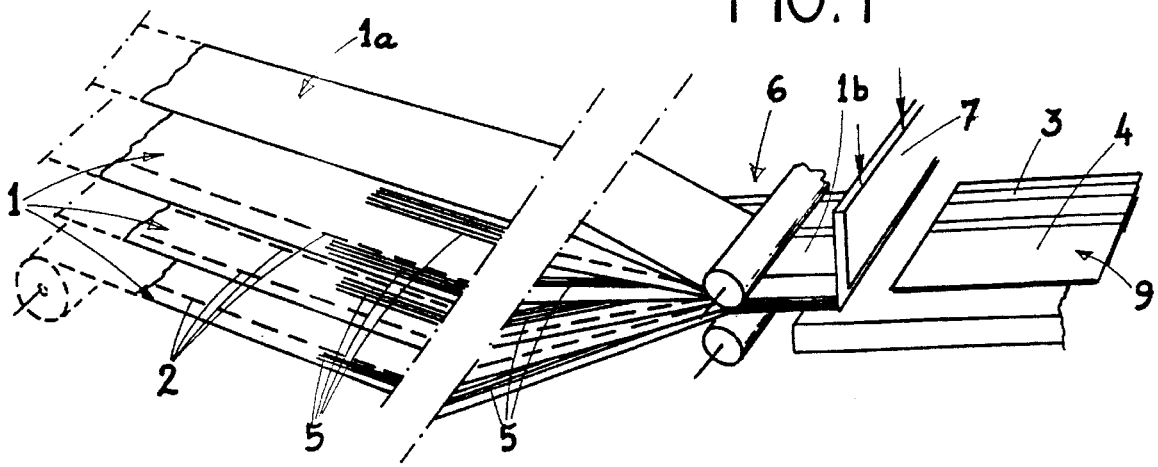
FIG. 1 is a schematic perspective view showing the steps of the method.
Figure 2:
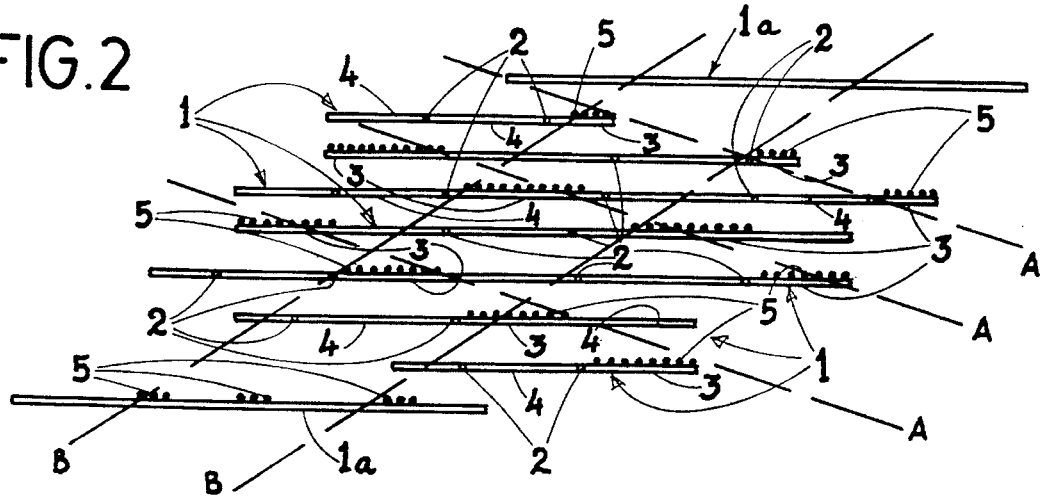
FIG. 2 is a schematic cross section of the glued strips before they are overlapped.

The divider for foldable cardboard boxes can be obtained by a manufacturing method which comprises a continuous displacement of an assembly or group of laminar cardboard strips -1- fed from as many bobbins (not shown) along a set path. At the beginning of this path the strips -1- are situated in different and separate planes, advantageously parallel to each other (FIGS. 1 and 2), but laterally offset from each other (FIG. 2). All the strips, or at least all of them less some strips -1*a*- which are on the end sides of the group (as in the version illustrated in FIGS. 1 and 2), present either from the start, or from one point of their initial travel, some longitudinal grooves -2- which divide them into a number of longitudinal bands -3- and -4-. These grooves can be formed by discontinuous cuts or by continuous grooves which do not pass completely through the strips. In any case their function, as will be seen below, is to form fold-lines towards one side or the other. Beads or lines of glue -5- will be deposited on the bands -3-. Lines or beads of glue -5- will also be deposited on one of the strips -1*a*-. It is important to stress that the bands -3- which have lines of glue -5- deposited on them occupy positions offset from each other, following virtual lines A and B running diagonally with respect to the group of strips -1, 1*a*- (FIG. 2).

Figure 3:
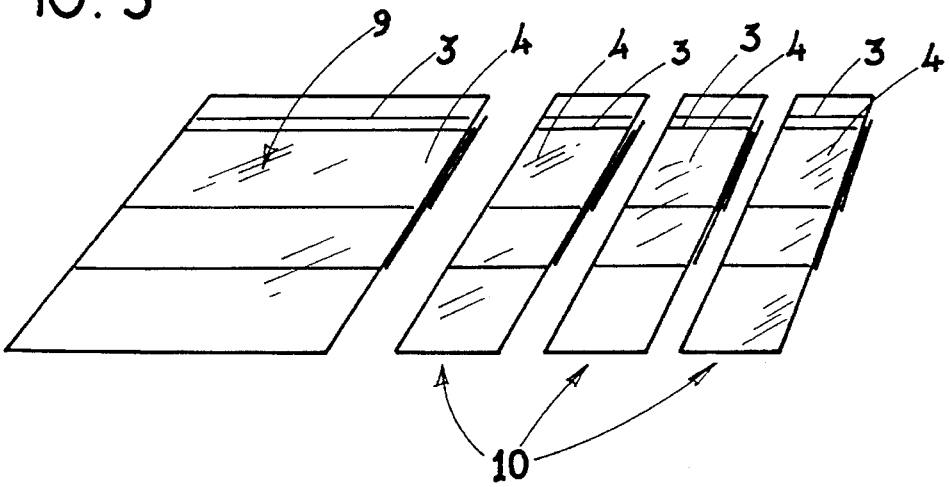
FIG. 3 shows schematically the cutting into pieces of some sections of the precut glued strips, into shorter sections which constitute the folded dividers.
Figure 7:
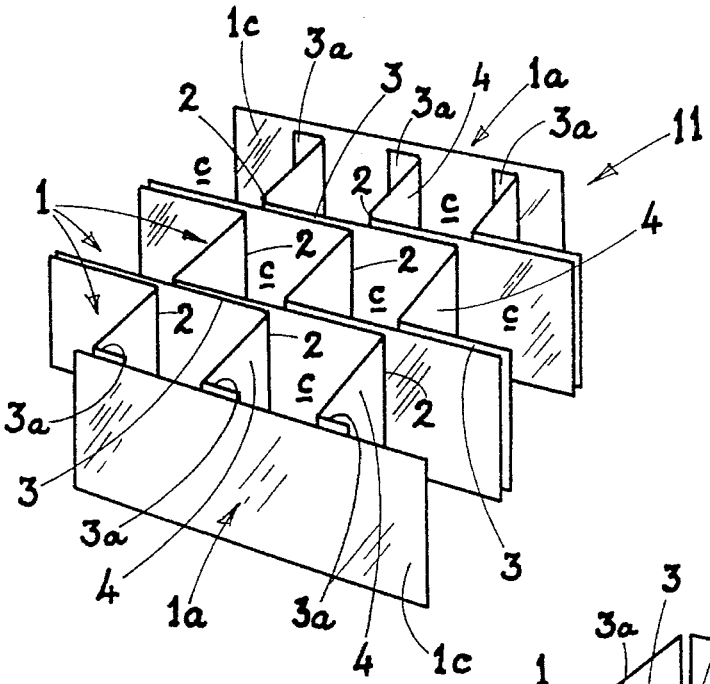
FIG. 7 is a view of an unfolded divider, provided on two opposite sides with two end sheets glued onto other folded flaps.
Figure 8:
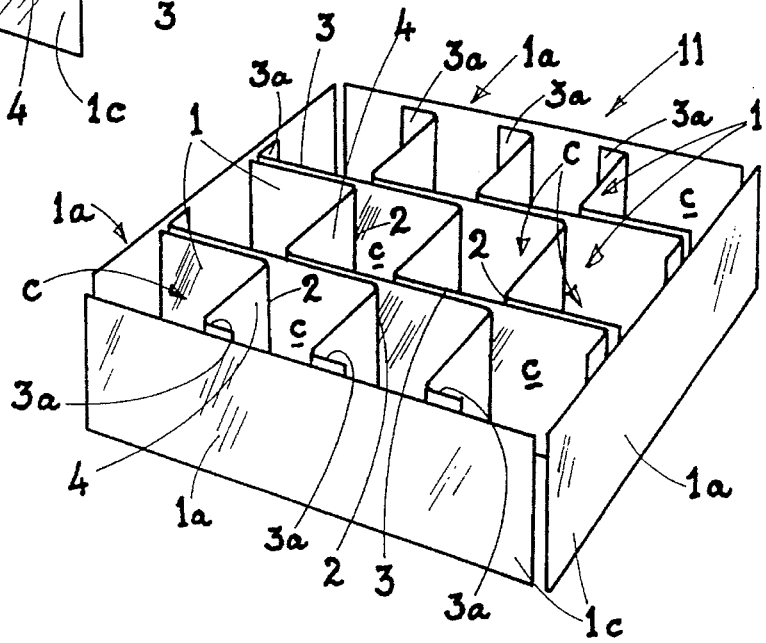

On their downstream travel along the path, the strips -1, 1*a*- converge progressively until, at a station of general reference -6- (comprising, for example, two adjacent rollers), they are overlapped on each other and glued under pressure. From this station -6-, the strips form a glued assembly -1*b*- which passes through a transverse cutting station -7- to provide pieces -9-, which in the version shown (FIGS. 1 and 3) will be cut again into shorter pieces -10-, which will constitute the folded dividers.

By virtue of the position of the glued bands -3-, upon unfolding of the piece -10- a divider -11- is formed, in which the strips -1- are linked to each other through the unglued sections -4-, arranged at right angles to the glued sections -3-, with the special feature that the sections -3- of each strip -1- are folded in opposite directions along the fold-lines formed by the grooves -2-. Compartments "C" are defined between the sections -4- and the sheets -1-, to hold bottles or other articles.

It should be noted that at the ends of the strips situated on two or four sides of the divider -11-, narrow flap-like bands -3*a*- are defined, with those on either side of the divider arranged in coplanar manner; these can then be glued directly to the sides of an unfolded box -12-, or to sheets -1*a*- of the divider itself, which shall in turn be juxtaposed onto the sides of the box -12- (FIGS. 6 to 9), depending on whether the divider is fitted into the box using a mechanical or manual method, as outlined in greater detail below.

At the cutting station -7- and other stations down the line but not shown, straight cuts can be made to provide pieces -9- and -10- having straight longitudinal edges (FIGS. 1, 3 and 4), or else broken or mixed outline cuts to form recesses -13- on one of the longitudinal edges (either the upper or lower), whose outline narrows progressively from the edge in question, as illustrated in FIG. 5 of the drawings. When the divider is fitted between the bottles previously situated in a box, or when bottles are placed into the divider fitted into the box, these recesses -13- prevent the edge of the divider from striking against the edges of the bottle labels and causing them to come away.

As can be deduced from all that has been described and from observation of the drawing, the above method allows fully finished dividers to be obtained in a continuous process, at a much higher production rate than with any of the known manufacturing methods and, therefore, at lower cost.

With this procedure the dividers are obtained from continuous laminar cardboard strips, of lower cost than the ridged cardboard sheets which have been used to manufacture known dividers.

Figure 9:
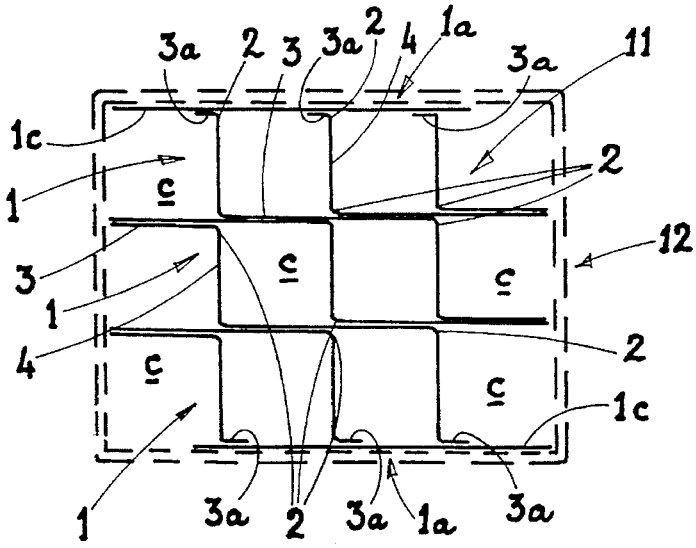
FIG. 9 is a plan view of a divider of the version illustrated in FIG. 7, situated inside a box.

The divider, furthermore, independently of the manufacturing method used, has several advantages with respect to known versions. In the first place, it can be incorporated into a box using a mechanized process: in this case the divider would be one like that shown in FIG. 6 of the drawings, with the flaps -3*a*- glued onto the sides of the box. It is also possible to obtain a divider with sheets -1*a*- (FIGS. 7 and 8), for manual placement inside the box -12-. In this case, at least one of the ends -1*c*- of the sheets - 1*a*- rests on the sides of the box -12- to prevent it being folded accidentally. Between the end -1*c*- and the immediately adjacent section -4- there is a space equivalent to that existing between two parallel and immediately adjacent sections -4- of the divider, in order to form compartments "C" (FIG. 9).

It should be noted, finally, that the divider object of the invention could be obtained from precut sheets instead of from continuous strips -1-.

Independent of the object of the invention shall be the number of strips of cardboard or similar material from which the dividers are obtained, as well as their dimensions and, consequently, the number and dimensions of the sheets or strips formed by the manufactured dividers. The particular mechanisms used to carry out the different steps of the method shall also be optional.

I claim:

1. A method for manufacturing a divider for insertion into cardboard boxes, comprising the steps of:

continuously feeding strips of flexible material along a path, each of said strips moving initially in a different plane, providing said strips with longitudinal grooves which will define fold lines in a longitudinal direction and which divide the strip into longitudinal bands, applying an adhesive to at least some of said strips in transversely offset positions, directing said strips to converge progressively until they overlap on each other and adhere to each other under pressure applied at the transversely offset positions at which the adhesive is applied to said at least some of said strips to form an assembly of strips which are overlapped and adhered to one another, and cutting the assembly of strips which are overlapped and adhered to one another by means of at least one transverse cutting operation to provide pieces which will constitute the folded dividers which will be unfolded and adhered to at least two opposite sides of a box, said cutting step comprising the step of forming at least one inwardly directed recess at a first longitudinal end of each of said pieces and forming at least one outwardly directed projection at an opposite, second longitudinal end of each of said pieces.

2. The method of claim 1, wherein said adhesive is glue.

3. A method for manufacturing a divider for foldable cardboard boxes as claimed in claims 2, characterized in that the glue is applied in bands, the bands of each sheet being offset with respect to those of the following sheets according to several imaginary lines in a diagonal direction with respect to the assembly of sheets.

4. A method for manufacturing a divider for foldable cardboard boxes as claimed in claim 2, characterized in that the assembly of overlapped and glued strips is cut along straight lines.

5. The method of claim 1, wherein said strips are provided with longitudinal grooves which divide the strip into longitudinal bands of different widths.

6. The method of claim 1, wherein said step of applying the adhesive comprises the step of applying beads of glue oriented in the longitudinal direction of said strips.

7. The method of claim 1, wherein said cutting step comprises the step of forming in each of said at least one transverse cutting operation a plurality of inwardly directed recesses at said first longitudinal end of each of said pieces and a plurality of outwardly directed projections at said opposite, second longitudinal end of an adjacent one of said pieces.

8. The method of claim 1, wherein said at least one recess in said first longitudinal end of each of said pieces narrows progressively from said first longitudinal end.

9. A method for manufacturing a divider for insertion into cardboard boxes, comprising the steps of:

continuously feeding strips of flexible material along a path, providing said strips with longitudinal grooves which will define fold lines in a longitudinal direction and which divide the strip into longitudinal bands, applying an adhesive to at least some of said strips in transversely offset positions, directing said strips to converge progressively until they overlap on each other and adhere to each other under pressure applied at the transversely offset positions at which the adhesive is applied to said at least some of said strips to form an assembly of strips which are overlapped and adhered to one another, and continuously cutting the assembly of strips which are overlapped and adhered to one another by means of transverse cutting operations to provide pieces which will constitute the folded dividers which will be unfolded and adhered to sides of a box, said cutting step comprising the step of forming in each of said transverse cutting operations a plurality of inwardly directed recesses at a first longitudinal end of each of said pieces and a plurality of outwardly directed projections at an opposite, second longitudinal end of an adjacent one of said pieces such that said outwardly directed projections are complementary to said inwardly directed recesses.

* * * * *